US006666195B2

(12) United States Patent
Vogel et al.

(10) Patent No.: US 6,666,195 B2
(45) Date of Patent: Dec. 23, 2003

(54) METHOD FOR PRODUCING A SEQUENCE OF HIGH-VOLTAGE IGNITION SPARKS AND HIGH-VOLTAGE IGNITION DEVICE

(75) Inventors: Manfred Vogel, Ditzingen (DE); Werner Herden, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/203,059

(22) PCT Filed: Jan. 8, 2001

(86) PCT No.: PCT/DE01/00031

§ 371 (c)(1),
(2), (4) Date: Oct. 8, 2002

(87) PCT Pub. No.: WO01/55588

PCT Pub. Date: Aug. 2, 2001

(65) Prior Publication Data

US 2003/0089355 A1 May 15, 2003

(30) Foreign Application Priority Data

Jan. 26, 2000 (DE) ..... 100 03 109

(51) Int. Cl.[7] ..... F02P 3/02
(52) U.S. Cl. ..... 123/620; 123/637; 123/627
(58) Field of Search ..... 123/620, 627, 123/618, 652, 655, 637

(56) References Cited

U.S. PATENT DOCUMENTS 3,853,107 A * 12/1974 Sieja ..... 123/598
4,688,538 A * 8/1987 Ward et al. ..... 123/598
4,836,176 A 6/1989 Fujino et al.
5,131,376 A * 7/1992 Ward et al. ..... 123/598
5,462,036 A * 10/1995 Kugler et al. ..... 123/609
5,488,940 A 2/1996 Kugler et al.
5,495,150 A * 2/1996 Zawislak et al. ..... 315/294
5,505,175 A 4/1996 Kollmann et al.
5,623,209 A * 4/1997 Lepley et al. ..... 324/382
6,138,653 A * 10/2000 Juffinger ..... 123/598

FOREIGN PATENT DOCUMENTS

| | | |
|---|---|---|
| EP | 0 652 363 | 5/1995 |
| EP | 0 893 600 | 1/1999 |

* cited by examiner

*Primary Examiner*—John Kwon
(74) *Attorney, Agent, or Firm*—Kenyon & Kenyon

(57) ABSTRACT

A method of generating a sequence of high-voltage ignition sparks is described, wherein an ignition energy storage device is charged up to a specifiable charge state. By a discharge of the ignition energy storage device, a spark is generated on an ignition spark generating means connected to the ignition energy storage device. A recharging operation of the ignition energy storage device is started before the ignition energy storage device is completely discharged. By discharging the ignition energy storage device, an additional ignition spark is generated on the ignition spark generating means.

14 Claims, 2 Drawing Sheets

METHOD FOR PRODUCING A SEQUENCE OF HIGH-VOLTAGE IGNITION SPARKS AND HIGH-VOLTAGE IGNITION DEVICE

FIELD OF THE INVENTION

The present invention relates to a method of generating a sequence of high-voltage ignition pulses and a high-voltage ignition device.

BACKGROUND INFORMATION

Various high-voltage ignition devices are known in the related art. In addition to inductive ignition, known systems also include capacitive ignition systems and a.c. ignition systems. Furthermore, there are known ignition systems in the related art in which a sequence of high-voltage ignition sparks is generated. This device, which is also known as double ignition, generates multiple ignition sparks during one combustion cycle in a cylinder in order to improve combustion. For this purpose, for example, there are known ignition systems having multiple ignition energy storage devices, e.g., ignition coils. The ignition spark sequence is controlled in time in the related art, this time control being implemented through software and/or hardware using a control unit. One disadvantage of the known multiple-spark systems is that there is a relatively long period of time between a charging and discharging operation of the ignition storage device. In addition, a greater material expenditure is necessary for ignition systems having multiple ignition energy storage devices.

SUMMARY OF THE INVENTION

Using the method of generating a sequence of high-voltage ignition pulses and using the high-voltage ignition device, it is possible in an advantageous manner to shorten the time between a discharging operation and a charging operation of an ignition energy storage device. This makes it possible to provide multiple high-voltage ignition sparks during one ignition cycle. However, it is also possible to reduce the capacitance of the ignition energy storage device due to the increase in the number of ignition sparks, i.e., for example, it is possible to use a smaller ignition coil in comparison with the related art. Essentially the shortening of the recharging time of the ignition energy storage device is achieved by recharging it before it is completely discharged. Thus, there remains a certain residual ignition energy in the ignition energy storage device, regardless of changes in such parameters as ignition voltage, operating voltage of the ignition spark, rotational speed of the internal combustion engine, ratio of the air-fuel mixture, battery voltage situation or the like, so that the recharging operation is shortened whereupon subsequent sparks may be generated at a much shorter interval after the first spark.

To prevent the ignition energy storage device from discharging completely by a simple method, in a refinement of the present invention, the ignition spark current is measured (while the ignition spark is burning) and when the ignition spark current drops below a specifiable value, the recharging operation of the ignition energy storage device is started. To prevent uncontrolled re-ignition on the ignition spark generating device which may be caused by current peaks in the ignition spark current, for example, in an especially preferred embodiment the recharging operation of the ignition energy storage device is started only when the ignition spark current has dropped below the specifiable value for a specified period of time. This also guarantees, however, a minimum spark duration, which will be necessary for ignition of the air-fuel mixture in the combustion chamber. Since restarting takes place only when the ignition spark current drops below the specifiable value, the short recharging time of the ignition spark storage device is also reached because residual ignition energy is available in the storage device.

If a measuring lead is provided from the ignition energy storage device to a control unit for an ionic current measurement, this measuring lead may be used to measure the ignition spark current. This also yields an inexpensive and robust implementation of control of the recharging operation by the control unit.

DETAILED DESCRIPTION

Figure 1:
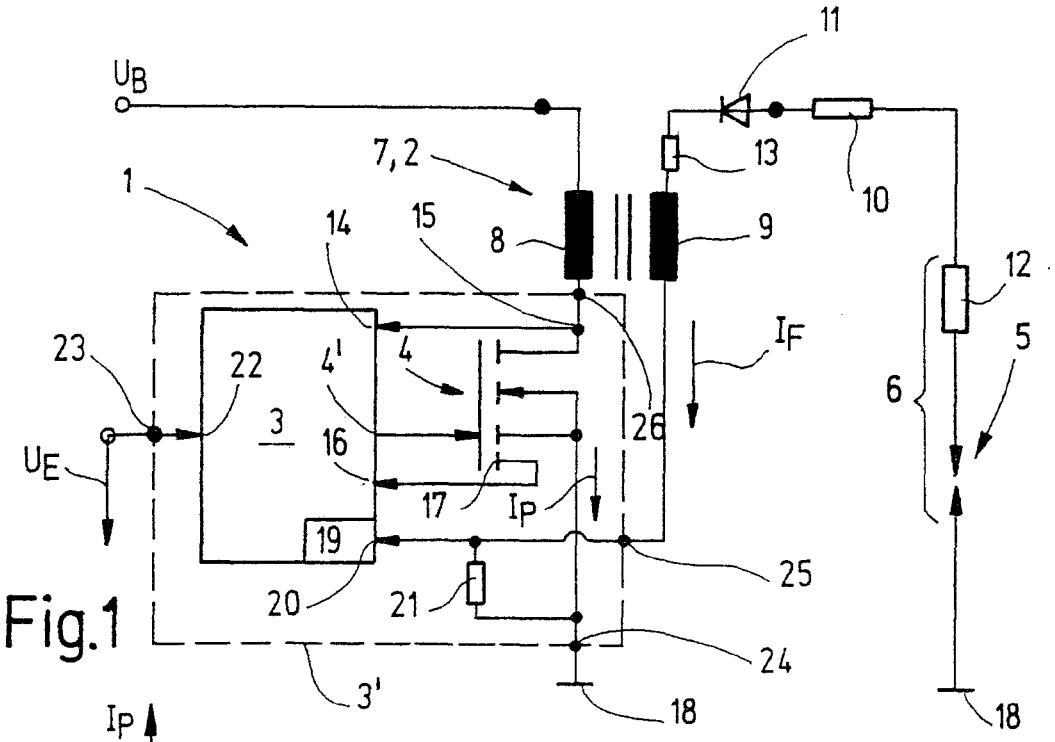
FIG. 1 shows a first embodiment of a high-voltage ignition device.

FIG. 1 shows a high-voltage ignition device 1 including an ignition energy storage device 2, a control unit 3 and a switching element 4. High-voltage ignition device 1 supplies electric power to a spark gap 5 to generate a high-voltage ignition spark. Spark gap 5 is formed on an ignition spark generating device 6, which may preferably be implemented as a spark plug.

In a preferred embodiment, ignition energy storage device 2 is designed as an inductor, i.e., as ignition coil 7 having a primary winding 8 and a secondary winding 9. Ignition spark generating device 6 is connected to secondary winding 9, an interference-suppression resistor 10 and a spark suppression diode 11 are also situated in this circuit, the anode being connected to spark gap 5 and the cathode being connected to secondary winding 9. Furthermore, bum-off resistor 12 of ignition spark generating device 6 and resistor 13 of ignition energy storage device 2 are also shown in this circuit. At one of its ends, secondary winding 9 is connected to spark gap 5, and at the other end of the winding it is connected to control unit 3.

At one of its ends, primary winding 8 is connected to a power supply voltage $U_B$ which is, for example, the battery voltage of an onboard battery of a motor vehicle. The other end of primary winding 8 may be connected to ground via switching element 4. The power supply circuit for primary winding 8 is opened or closed, depending on how switching element 4 is triggered by control unit 3 via a control output 4'. When switching element 4 is closed, ignition energy storage device 2 is charged. After successful charging of ignition energy storage device 2, the stored ignition energy is dissipated through spark gap 5 by opening switching element 4, thereby discharging ignition energy storage device 2.

Control unit 3 has a voltage measuring input 14 which is connected to a voltage tap 15 which is situated between primary coil 8 and switching element 4 in the circuit on the primary side to measure bracket voltage of ignition energy storage device 2. Furthermore, control unit 3 has a current measurement input 16 which is connected to a current tap 17 of switching element 4. Primary current $I_P$ is measured via this current measurement input 16, at least during the charging operation of ignition energy storage device 2. In addition, control unit 3 includes a determination device 19 which determines the charge state of energy storage device 2 at least during the generation of ignition sparks. To do so, in a preferred embodiment, the determination device has a current measurement input 20 which is connected to one end of secondary winding 9 to enable spark current $I_F$ to be measured during generation of the ignition spark. To allow this to be implemented easily and simply, one terminal of a measuring shunt 21, also known simply as a shunt, is connected to the connecting line between current measuring input 20 and secondary winding 9, the other terminal of measuring shunt 21 being connected to ground 18. Finally, control unit 3 has a control input 22 to which a control voltage $U_E$ may be applied, this voltage being output by a switching device.

The functioning of high-voltage ignition device 1 is explained below on the basis of FIGS. 1 and 2*a* through 2*c*. When control input 22 is activated, control voltage $U_E$ is applied during a period of time $t_0$ through $t_E$ (FIG. 2*c*). Then control unit 3 triggers switching element 4 so that the power supply circuit for primary winding 8 is closed and primary current $I_P$ increases after time $t_0$. Current $I_P$ changes as a function of the charge state of ignition energy storage device 2. On reaching a specifiable value $I_{P,ZÜND}$ at time $t_1$ switching element 4 is opened again via control unit 3 so that the subsequent discharging operation of ignition energy storage device 2 causes spark current $I_F$ to increase at time $t_1$ (FIG. 2*b*) whereupon the ignition spark bums at spark gap 5. Spark current $I_F$ drops due to the progressive discharge of ignition energy storage device 2. On reaching a specifiable trigger value $I_{TR}$ of spark current $I_F$ which is detected by determination device 19, switching element 4 is closed again by control unit 3 and a recharging operation of ignition energy storage device 2 is started at time $t_2$. The charging operation is implemented again until reaching value $I_{P,ZÜND}$ which was determined for the primary current at time $t_3$, whereupon switching element 4 is opened again by control unit 3 so that a subsequent ignition spark is ignited by the discharge operation at spark gap 5 at time $t_3$ and burns until ignition spark current $I_F$ has dropped back to trigger value $I_{TR}$ at time $t_4$, whereupon switching element 4 is closed again and another charging operation of the ignition energy storage device is carried out until the value of primary current $I_P$ has again reached value $I_{P,ZÜND}$ at time $t_5$. By opening switching element 4 again, a discharging operation of ignition storage device 2 takes place again which in turn generates an ignition spark at time $t_5$ at spark gap 5. However, triggering voltage $U_E$ at time $t_E$ is no longer applied to control output 22 so that control unit 3 does not close switching element 4 again and the ignition spark burns out completely. It is thus readily apparent that depending on triggering time $t_0$ through $t_E$ at time $t_1$ an initial spark may be generated, in period of time $t_2$ through $t_4$ at least one or more subsequent sparks may be generated, and at time $t_5$ a concluding ignition spark, which may burn out, is generated.

To prevent uncontrolled charging or discharging of the ignition energy storage device between two ignition sparks, e.g., in period of time $t_2$ to $t_3$, switching element 4 is closed for a charging operation of ignition storage device 2 only when ignition spark current $I_F$ has dropped below trigger value $I_{TR}$ for a certain period of time, e.g., 20 $\mu$s to 80 $\mu$s, so that current peaks are more or less filtered out and are not taken into account in triggering switching element 4. Trigger value $I_{TR}$ is lower than maximum current $I_{F,max}$ and may amount to 0.3 to 0.7 times maximum spark current $I_{F,max}$, for example. This trigger value $I_{TR}$ is thus variable, preferably as a function of at least one operating parameter of the engine. For example, the rotational speed and/or the engine load may be used for this purpose. In particular, a characteristics map field is available containing several characteristic curves so that trigger value $I_{TR}$ may be selected as a function of these operating characteristic curves of the engine. By changing trigger value $I_{TR}$, the duration of a single spark changes, and thus the number of sparks for a spark sequence may be changed.

FIG. 1 also shows that both control unit 3 and measuring shunt 21 as well as switching element 4, which is designed as a power switch in particular, may be manufactured inexpensively as unit 3' on a semiconductor substrate, so that only four terminals 23 through 26 need lead out of a housing accommodating this substrate. Of course control unit 3, measuring shunt 21 and switching element 4 may also be designed as separate components, which, however, may also be situated in a single housing having terminals 22 through 26.

Figure 3:
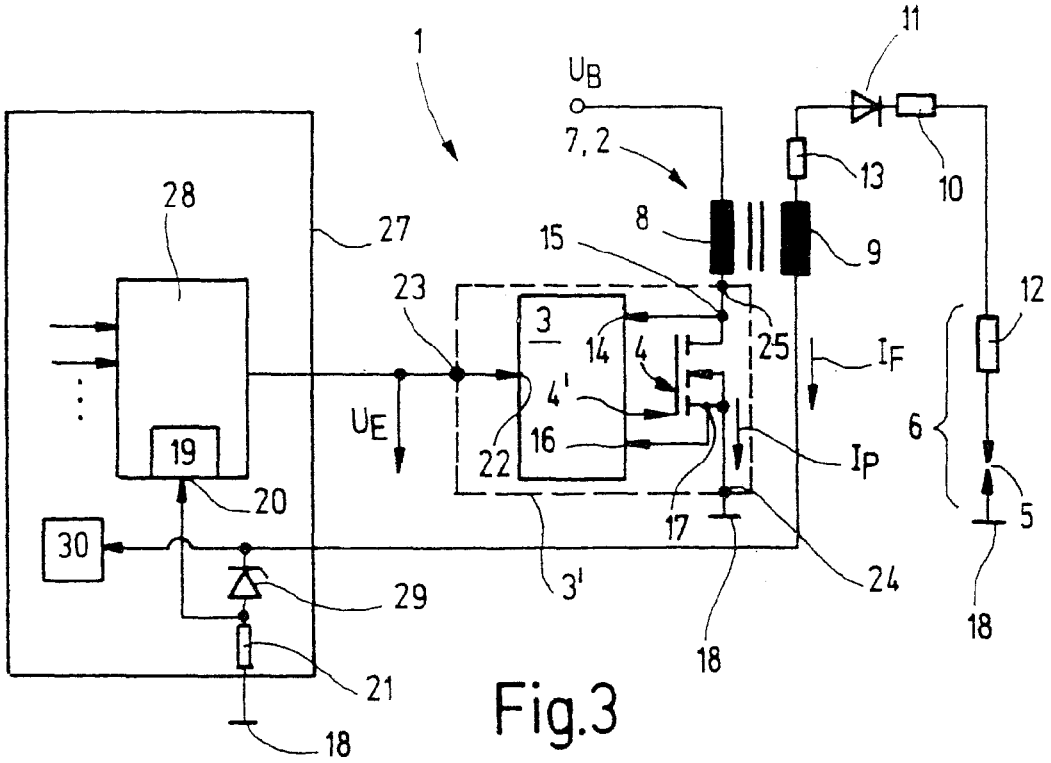
FIG. 3 shows a second embodiment of a high-voltage ignition device.
Figure 4:
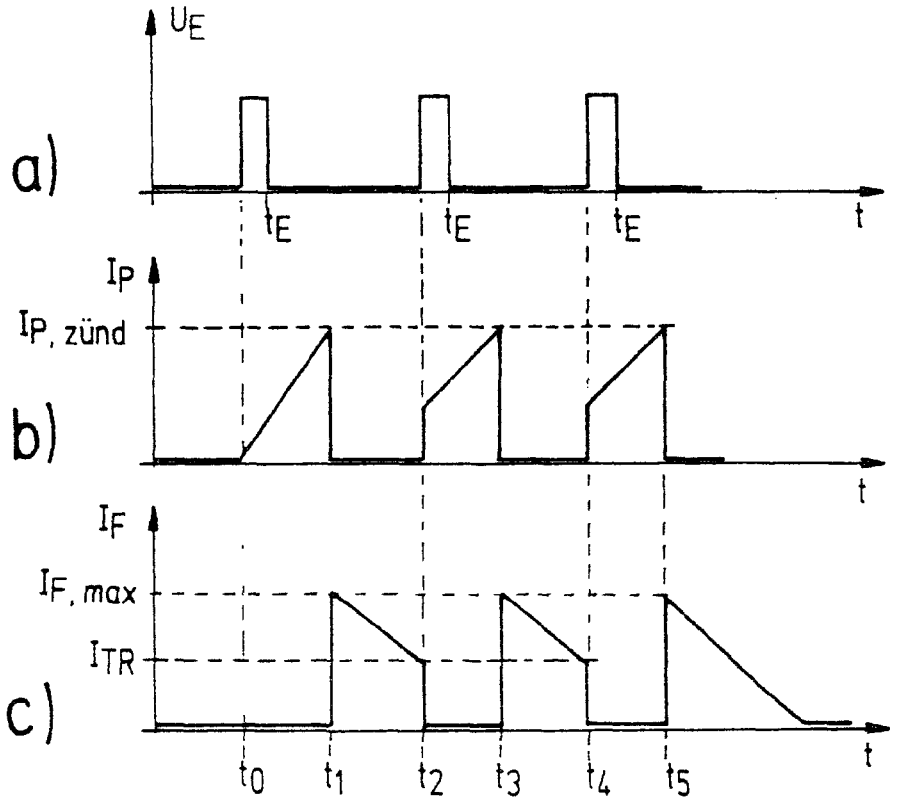
FIG. 4 shows the current and voltage curves over time of the high-voltage ignition device according to FIG. 3.

FIG. 3 illustrates a second embodiment of a high-voltage ignition device 1 in which determination device 19 is implemented in a switch unit 27 upstream from control unit 3, including a switch device 28 whose output end is connected to control input 22 of control unit 3 and which supplies control voltage $U_E$ for control unit 3. Control voltage $U_E$ is provided in pulse form according to FIG. 4*a*, namely as a function of spark current $I_F$. If this spark current $I_F$ reaches trigger value $I_{TR}$ (FIG. 4*c*) a control voltage pulse $U_E$ is again applied to control input 22 so that control unit 3 closes switching element 4 until primary current $I_P$ has reached ignition value $I_{P,ZÜ}$ND (FIG. 4*b*) whereupon switching element 4 is opened again so that by discharging spark energy storage device 2 a spark may again be supplied at spark gap 5. It is an advantage of this method of supplying control voltage $U_E$ that only three terminals 23, 24 and 25 lead out of housing which holds unit 3' having control unit 3 and switching element 4.

Figure 2:
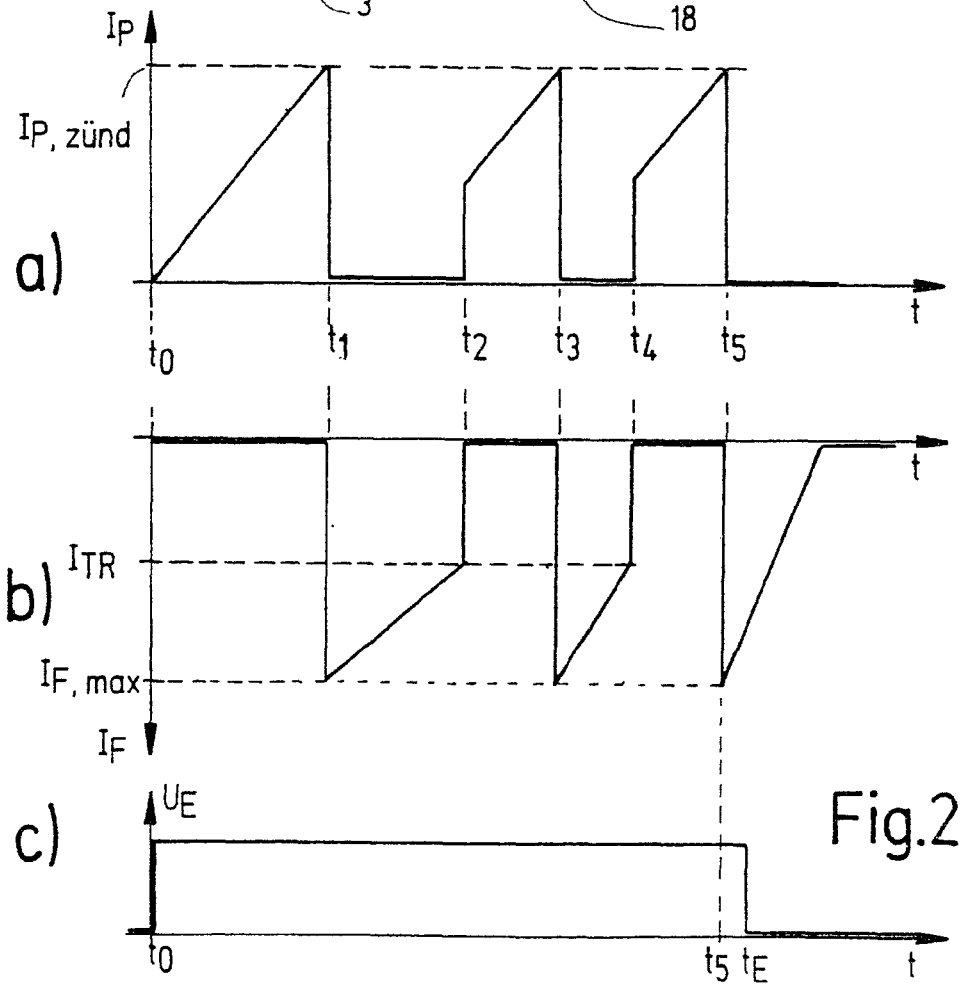
FIG. 2 shows the charging current of an ignition energy storage device of the high-voltage ignition device, the ignition spark current, and a control voltage, all plotted over time.

In this embodiment of high-voltage ignition device 1 according to FIG. 3, current measuring input 20 is tapped between a Zener diode 29 and measuring shunt 21, Zener diode 29 being connected in the forward direction for spark current $I_F$. The connecting line between secondary winding 9 and Zener diode 29 is continued up to an ionic current measuring device 30 with which the ionic circuit in the combustion chamber may be measured during ignition spark pauses to permit an evaluation of the knock characteristics of the engine, for example. Otherwise the same parts or those having the same effect as in FIGS. 1 and 2 are provided with the same reference notation in FIGS. 3 and 4. To this extent, reference is made to the description of these figures.

High-voltage ignition device 1 thus implements a way of multiple charging and discharging of ignition energy storage device 2, whereby, in order to reduce the pause times between two ignition sparks, the charging time is greatly shortened with respect to known systems for recharging ignition energy storage device 2 because residual energy always remains in ignition energy storage device 2. Thus it is possible to use inexpensive ignition energy storage devices, in particular coils having a primary energy of <100 mJ. By changing trigger value $I_{TR}$ for the spark current and changing shutdown current $I_{P,ZÜND}$, it is also possible to achieve an adaptation to the respective power supply voltage level in particular the charge state of the onboard battery. Furthermore, the duration of a spark sequence or the number of sparks during a spark sequence, may be varied.

The adjustment of the discharge time of the ignition energy storage device may also be adapted to the conditions in the secondary circuit of ignition energy storage device 2 and ignition spark generating device 6 so that tolerances in resistors 12, 10 and 13 in the secondary circuit may be compensated.

What is claimed is:

1. A method of generating a sequence of high-voltage ignition sparks, comprising:

charging an ignition energy storage ice up to a specifiable charge state;

generating a first spark on an ignition spark generating device connected to the ignition energy storage device by discharging the ignition energy storage device;

starting a recharging operation of the ignition energy storage device before the ignition energy storage device is completely discharged;

generating an additional ignition spark on the ignition spark generating device by discharging the ignition energy storage device; and during the generation of at least one of the first spark and the additional ignition spark, measuring an ignition spark current, wherein:

when the ignition spark current drops below a specifiable value, the recharging operation of the ignition energy storage device is started.

2. The method according to claim 1, wherein:

the ignition spark current is measured during the generation of at least one of the first spark and the additional ignition spark, and the recharging operation of the ignition energy storage device is started when the ignition spark current drops below the specifiable value.

3. The method according to claim 1, wherein:

the recharging operation of the ignition energy storage device is started when the ignition spark current has dropped below the specifiable value for a specifiable period of time.

4. The method according to claim 1, wherein:

at least one charging operation, one recharging operation, and one complete discharging operation of the ignition energy storage device take place within one combustion cycle.

5. The method according to claim 1, further comprising:

determining a number of recharging operations within a combustion cycle as a function of an operating parameter of an internal combustion engine.

6. The method according to claim 1, further comprising:

performing an ionic current measurement during an ignition spark pause;

determining a parameter from the ionic current measurement; and depending on the determined parameter, selecting a starting time of the recharging operation of the ignition energy storage device.

7. The method according to claim 1, wherein:

a trigger value for the ignition spark current is variable as a function of at least one operating parameter.

8. The method according to claim 7, wherein:

the at least one operating parameter includes at least one of a rotational speed of an internal combustion engine and a load of the internal combustion engine.

9. A high-voltage ignition device for generating a spark sequence, comprising:

an ignition energy storage device;

a switching element for the ignition energy storage device, the switching element connecting a power supply device to and disconnecting the power supply from the ignition energy storage device;

a control unit for triggering the switching element; and a determination device for a charge state of the ignition energy storage device, wherein:

the control unit recloses the switching element when the charge state of the ignition energy storage device drops below a specifiable value, the switching element is reopened when a specifiable charge state is reached again, and the determination device includes a current measuring device for a spark current.

10. The high-voltage ignition device according to claim 9, wherein:

the ignition energy storage device includes an inductor.

11. The high-voltage ignition device according to claim 9, wherein:

the control unit includes the determination device.

12. The high-voltage ignition device according to claim 9, wherein:

the switching element includes a semiconductor switching element.

13. The high-voltage ignition device according to claim 12, further comprising:

a substrate on which the semiconductor switching element and the control unit are situated.

14. The high-voltage ignition device according to claim 9, further comprising:

an ionic current measuring device.

* * * * *

UNITED STATES PATENT AND TRADEMARK OFFICE

CERTIFICATE OF CORRECTION

PATENT NO. : 6,666,195 B2
DATED : December 23, 2003
INVENTOR(S) : Manfred Vogel et al.

It is certified that error appears in the above-identified patent and that said Letters Patent is hereby corrected as shown below:

Column 2,
Line 43, change “bum-off” to -- burn-off --.

Column 3,
Line 31, change “bums” to -- burns --.

Column 4,
Line 33, change “$I_{P,ZÜ}$ND” to -- $I_{P,\ ZÜND}$ --.

Column 5,
Line 10, change “storage ice” to -- storage device --.

Signed and Sealed this

Second Day of November, 2004

JON W. DUDAS
*Director of the United States Patent and Trademark Office*